US007097506B2

(12) United States Patent
Nakada

(10) Patent No.: US 7,097,506 B2
(45) Date of Patent: Aug. 29, 2006

(54) CONTACT MODULE IN WHICH MOUNTING OF CONTACTS IS SIMPLIFIED

(75) Inventor: Kouji Nakada, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/834,061

(22) Filed: Apr. 29, 2004

(65) Prior Publication Data

US 2004/0201084 A1 Oct. 14, 2004

(51) Int. Cl.
*H01R 13/648* (2006.01)

(52) U.S. Cl. ..... 439/608

(58) Field of Classification Search ..... 439/608, 439/108, 607, 540.1, 701, 736
See application file for complete search history.

(56) References Cited

U.S. PATENT DOCUMENTS 4,676,576 A * 6/1987 Feldberg et al. ..... 439/404
6,409,543 B1 * 6/2002 Astbury et al. ..... 439/608
6,551,140 B1 * 4/2003 Billman et al. ..... 439/608
6,843,487 B1 * 1/2005 Lotman ..... 280/43

FOREIGN PATENT DOCUMENTS

JP 2537698 7/1996
JP 2000113928 4/2000

* cited by examiner

*Primary Examiner*—Chandrika Prasad
*Assistant Examiner*—Phuongchi Nguyen
(74) *Attorney, Agent, or Firm*—Baker Botts L.L.P.

(57) ABSTRACT

A contact module includes a plurality of conductive contacts and an insulator retaining the contacts. Each of the contacts includes a contact portion at one end thereof, a terminal portion at the other end thereof, and an intermediate portion extending between the contact portion and the terminal portion. The intermediate portion has a positioning-subject portion. The insulator includes grooves each receiving therein the intermediate portion of the corresponding contact, positioning portions each positioning the positioning-subject portion of the corresponding contact, and retaining portions each retaining the intermediate portion of the corresponding contact. The positioning-subject portions of the contacts are press-fitted into the positioning portions of the insulator so that the contacts are provisionally retained by the insulator. By the use of the retaining portions, the contacts are finally retained by the insulator.

12 Claims, 8 Drawing Sheets

6
9
8
19
16
13
10
14
11
II f

CONTACT MODULE IN WHICH MOUNTING OF CONTACTS IS SIMPLIFIED

BACKGROUND OF THE INVENTION

The present invention relates to a contact module having an insulator and a conductive contact mounted on the insulator, and further relates to a connector using such a contact module.

A connector of the type is disclosed in, for example, Japanese Patent (JP-B) No. 2537698 and comprises a plurality of contact modules each called a terminal assembly, which are stacked together. Each contact module comprises a plurality of conductive terminals and an insulator overmolded on the terminals to retain them. In the production of each terminal assembly, a lead frame having a plurality of terminals is obtained by pressing a metal plate. An insulator is overmolded on the lead frame, then an unnecessary part of the lead frame is cut off.

The connector is suitable for electrically connecting between two boards arranged perpendicular to each other. However, an expensive die assembly is required for overmolding the lead frame with the insulator. Further, the production process of the terminal assembly is complicated.

A connector of the type is also disclosed in JP-A-2000-113928 and comprises a plurality of contact modules each called a connecting body, which are stacked together. Each contact module comprises two resin members and a plurality of conductive contacts sandwiched between the resin members.

The connector does not require to overmold the contacts by resin material. However, since the two resin members having different shapes are employed, the number of parts becomes large, two kinds of expensive die assemblies are required, and further, the assembling process of the connecting body becomes complicated.

SUMMARY OF THE INVENTION

It is therefore an object of the present invention to provide a contact module that can be produced at a lower price, with a less number of parts, and with a simplified production process.

It is another object of the present invention to provide a connector using the foregoing contact module.

Other objects of the present invention will become clear as the description proceeds.

According to an aspect of the present invention, there is provided a contact module comprising a conductive contact and an insulator retaining the conductive contact, the conductive contact comprising a contact portion at one end thereof, a terminal portion at the other end thereof, and an intermediate portion connecting the conductive contact portion and the terminal portion to each other and having a positioning-subject portion, the insulator comprising a groove receiving therein the intermediate portion of the conductive contact, a positioning portion positioning the positioning-subject portion of the conductive contact, and a retaining portion retaining the intermediate portion of the conductive contact.

According to another aspect of the present invention, there is provided a contact module comprising a plurality of conductive contacts and an insulator retaining the conductive contacts, each of the conductive contacts comprising a contact portion at one end thereof, a terminal portion at the other end thereof, and an intermediate portion connecting the conductive contact portion and the terminal portion to each other and having a positioning-subject portion, the insulator comprising grooves each receiving therein the intermediate portion of the corresponding contact, positioning portions each positioning the positioning-subject portion of the corresponding contact, and retaining portions each retaining the intermediate portion of the corresponding contact.

According to still another aspect of the present invention, there is provided aconnector comprising a plurality of plate-like contact modules stacked together, each of the conductive contact modules comprising a conductive contact and a plate-like insulator retaining the conductive contact, the conductive contact comprising a contact portion at one end thereof, a terminal portion at the other end thereof, and an intermediate portion connecting the conductive contact portion and the terminal portion to each other and having a positioning-subject portion, the insulator comprising a groove receiving therein the intermediate portion of the conductive contact, a positioning portion positioning the positioning-subject portion of the conductive contact, and a retaining portion retaining the intermediate portion of the conductive contact.

DESCRIPTION OF THE PREFERRED EMBODIMENT

Figure 1:
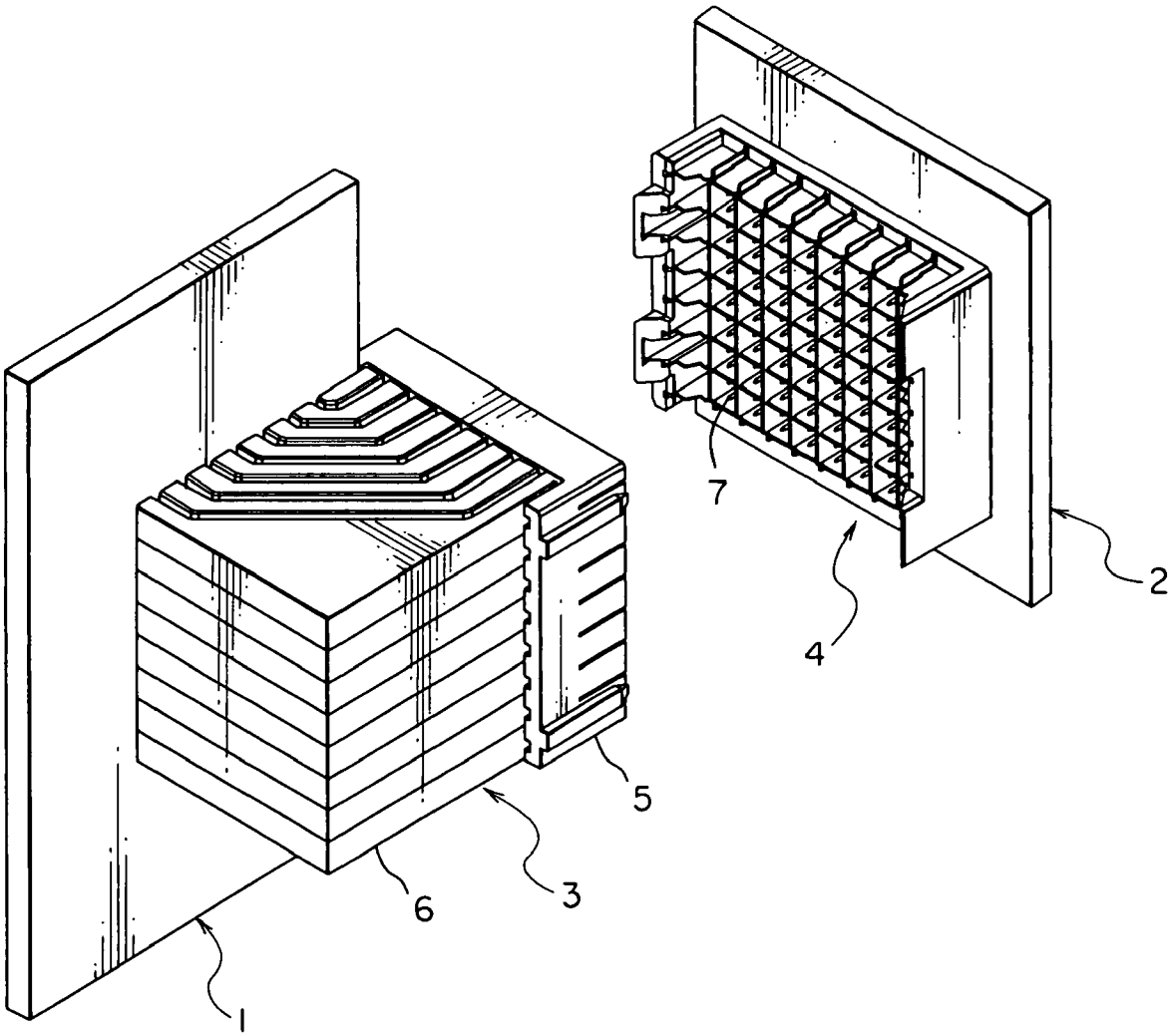
FIG. 1 is a perspective view of a plug connector as a connector according to a preferred embodiment of the present invention and a receptacle connector before they are fitted together.

Referring to FIG. 1, description will be made of a connector according to a preferred embodiment of the present invention.

The connector illustrated in FIG. 1 serves to electrically connect between a backplane 1 and a midplane 2 each being a circuit board, and is in the form of a plug connector 3 press-fitted to the backplane 1. A receptacle connector 4 is press-fitted to the midplane 2. When the plug connector 3 is fitted into the receptacle connector 4, the backplane 1 and the midplane 2 are electrically connected to each other.

The plug connector 3 comprises a front housing 5 and eight contact modules 6 attached to the front housing 5. The receptacle connector 4 has a number of pin contacts 7 arranged in a matrix.

Referring to FIGS. 2A to 2F, the contact modules 6 will be described.

Each contact module 6 comprises seven socket contacts 8 and a molded member made of an insulating material, i.e. an insulator 9. The socket contacts 8 are mounted on the insulator 9 so as to be spaced apart from each other. The socket contacts 8 are each bent into a 90° angle shape and have mutually different lengths.

Incidentally, the seven socket contacts 8 are collectively called herein a contact set.

Figure 3B:
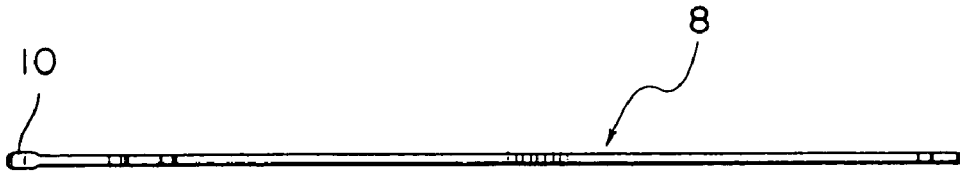
FIG. 3B is a plan view of the contact set.
Figure 3A:
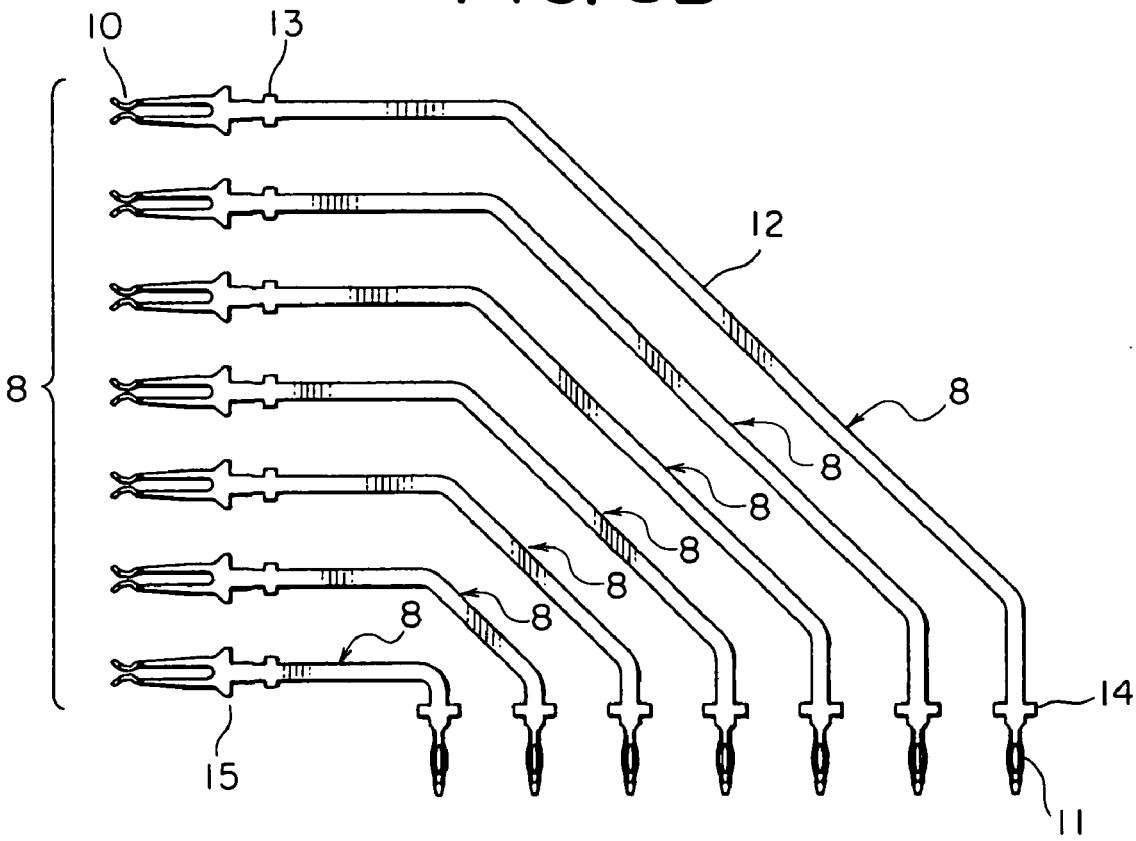
FIG. 3A is a front view of a contact set included in the contact module of FIGS. 2A to 2F.
Figures 4A, 4B, 4C, 4D:
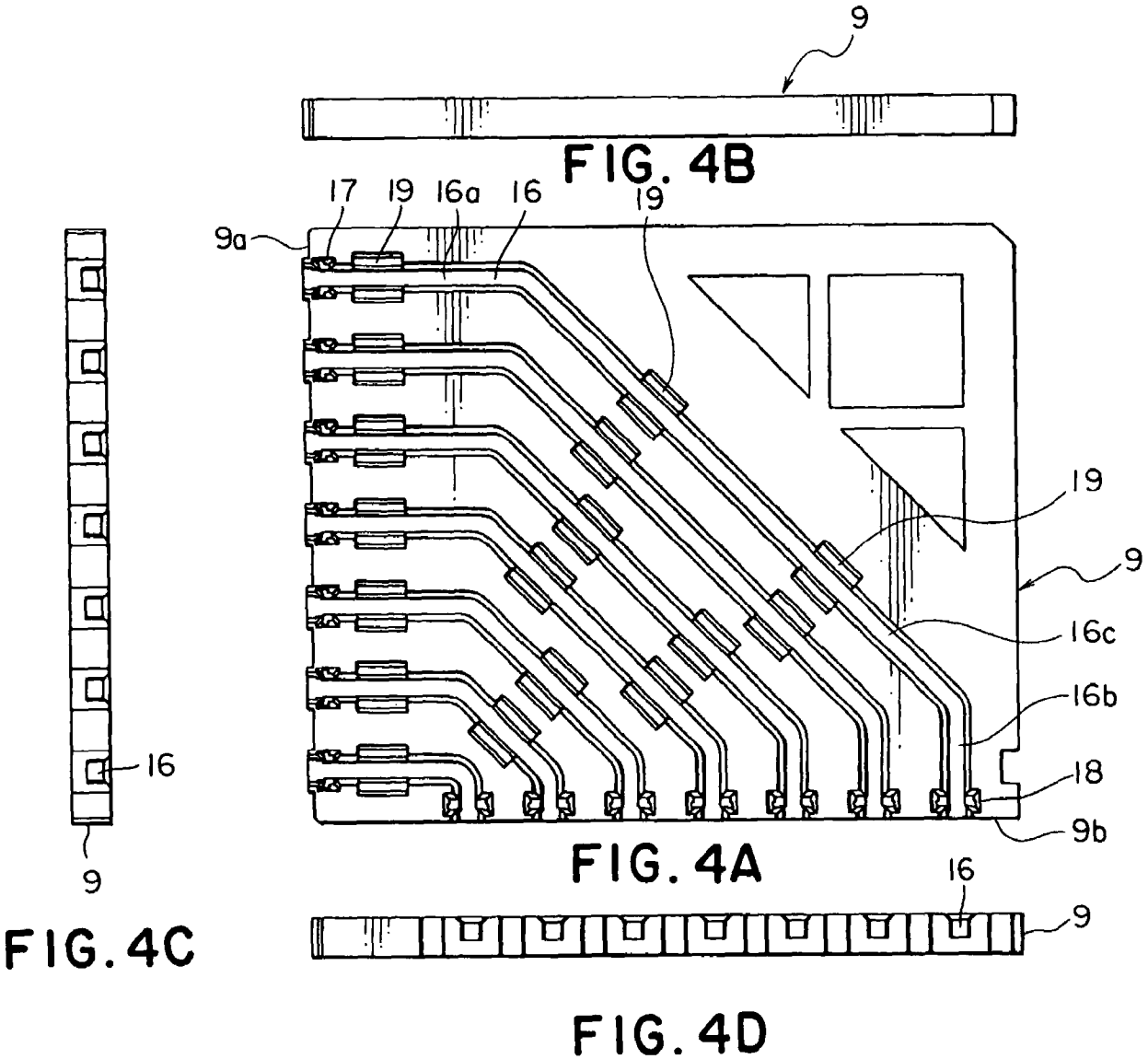
FIG. 4A is a front view of an insulator included in the contact module of FIGS. 2A to 2F.
FIG. 4B is a plan view of the insulator.
FIG. 4C is a side view of the insulator.
FIG. 4D is a bottom view of the insulator.
Figures 5A, 5B, 5C, 5D, 5E, 5F:
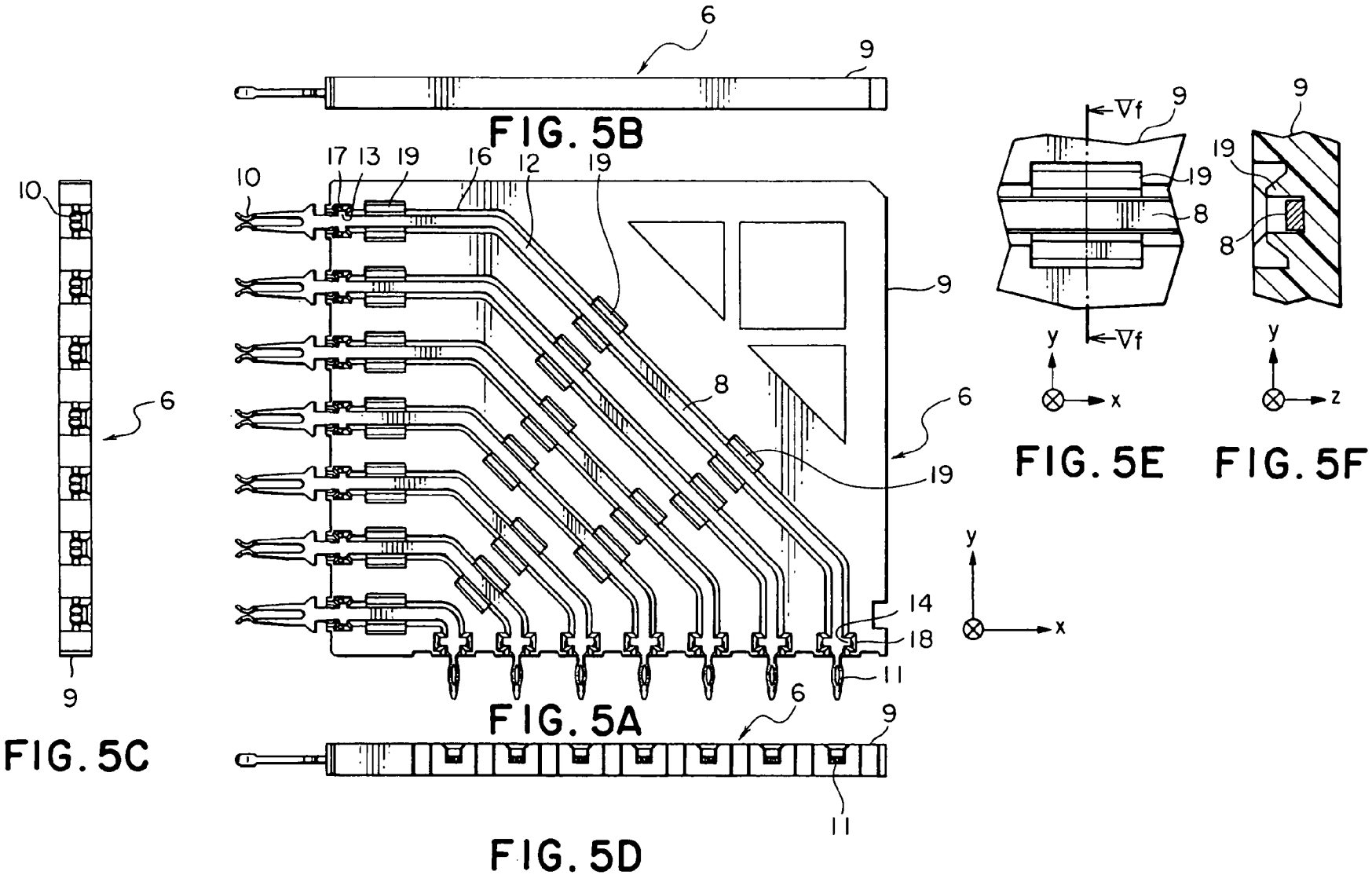
FIG. 5A is a front view showing a provisional mounting state where the contact set shown in FIGS. 3A and 3B is provisionally retained by the insulator shown in FIGS. 4A to 4D.
FIG. 5B is a plan view of the provisional mounting state.
FIG. 5C is a side view of the provisional mounting state.
FIG. 5D is a bottom view of the provisional mounting state.
FIG. 5E is an enlarged view of the main part of FIG. 5A.
FIG. 5F is a sectional view taken along line Vf—Vf in FIG. 5E.

Referring to FIGS. 3A and 3B, the socket contacts 8 will be described.

Each socket contact 8 has one end provided with a contact portion 10 for engagement with the corresponding pin contact 7 of the receptacle connector 4, the other end provided with a terminal portion 11 for connection to the backplane 1, and an intermediate portion 12 extending between the contact portion 10 and the terminal portion 11. The intermediate portion 12 has shoulder portions 13 and 14 in the vicinities of the contact portion 10 and the terminal portion 11, respectively. Each of the shoulder portions 13 and 14 is in the form of a pair of projections. The shoulder portions 13 and 14 conjointly serve as a positioning-subject portion for performing a positioning function upon mounting the socket contact 8 onto the insulator 9. The intermediate portion 12 further has, between the contact portion 10 and the shoulder portion 13, a press-fitting portion 15 that is press-fitted into the front housing 5.

Referring to FIGS. 4A to 4D, the insulator 9 will be described.

The insulator 9 has a rectangular plate-like shape, but may have another substantially polygonal plate-like shape. On the surface of the insulator 9, seven grooves 16 are formed concave in one-to-one correspondence with the socket contacts 8. The socket contacts 8 are received in the grooves 16, respectively. In the vicinities of both ends of each groove 16 are respectively formed recessed portions 17 and 18 that are engaged with the shoulder portions 13 and 14, respectively. Each of the recessed portions 17 and 18 is in the form of a pair of recesses. The recessed portions 17 and 18 are collectively called herein a positioning portion.

Further, the insulator 9 is formed with seventeen caulking portions 19 in the vicinities of the grooves 16 for fixing the socket contacts 8. The grooves 16 include relatively long and short ones. Only one caulking portion 19 is arranged in the vicinity of the relatively short groove 16, while a plurality of caulking portions 19 are arranged in the vicinities of the relatively long groove 16 so as to be spaced apart from each other along the groove 16. As will be described in detail later, the caulking portions 19 serve to retain or hold the intermediate portions 12 of the socket contacts 8 by forcible deformation thereof, i.e. by caulking. Therefore, the caulking portion 19 for the relatively short groove 16 or the caulking portions 19 for the relatively long groove 16 is called or are collectively called herein a retaining portion or a holding portion.

Each of the relatively long grooves 16 comprises a first portion 16*a* extending perpendicular to a first side 9*a* of the rectangular insulator 9, a second portion 16*b* extending perpendicular to a second side 9*b* adjacent to the first side 9*a*, and a third portion 16*c* extending between the first and second portions 16*a* and 16*b*. The third portion 16*c* extends obliquely to the first and second sides 9*a* and 9*b*.

Figures 2A, 2B, 2C, 2D, 2E, 2F:
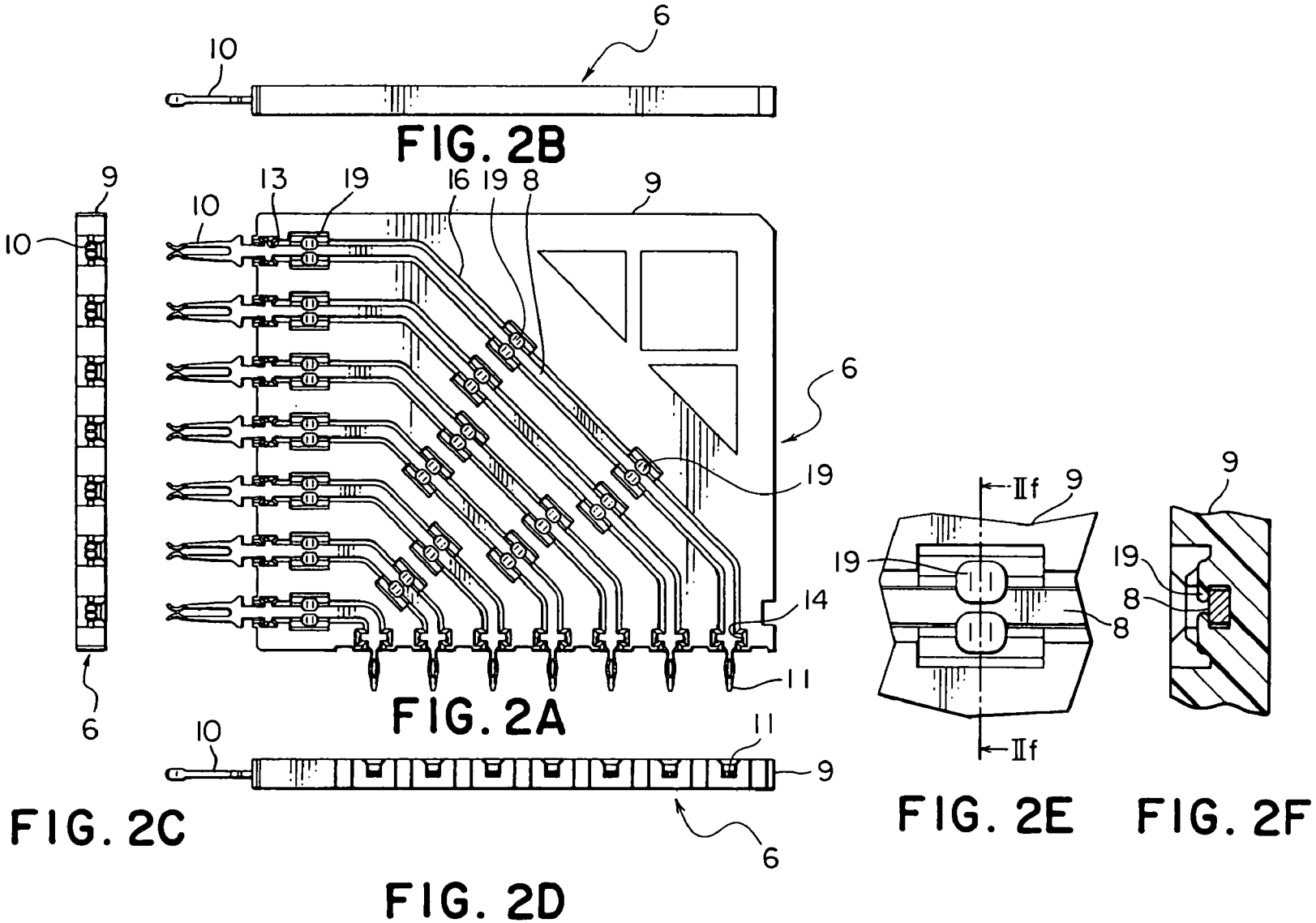
FIG. 2A is a front view of a contact module included in the plug connector of FIG. 1.
FIG. 2B is a plan view of the contact module.
FIG. 2C is a side view of the contact module.
FIG. 2D is a bottom view of the contact module.
FIG. 2E is an enlarged view of the main part of FIG. 2A.
FIG. 2F is a sectional view taken along line IIf—IIf in FIG. 2E.

As seen from FIG. 2A, the socket contacts 8 have shapes corresponding to the shapes of the grooves 16, respectively. Further, as seen from FIGS. 2C, 2D, and 2F, the socket contacts 8, the recessed portions 17 and 18, and the caulking portions 19 are designed not to project from the surface of the insulator 9. Therefore, each contact module 6 has a plate-like shape as a whole.

Now, referring also to FIGS. 5A to 5F, description will be given about mounting of the socket contacts 8 relative to the insulator 9.

First, the intermediate portion 12 of each socket contact 8 is placed in the corresponding groove 16 of the insulator 9. In this event, the shoulder portions 13 and 14 of each socket contact 8 are respectively press-fitted into the recessed portions 17 and 18 of the corresponding groove 16. In this state, each socket contact 8 is provisionally retained or held by the insulator 9. Consequently, each socket contact 8 is fixed relative to the insulator 9 so as not to be movable in either an x-direction or a y-direction.

Then, when each caulking portion 19 of the insulator 9 is deformed by squashing it using a jig, the caulking portion 19 encloses the intermediate portion 12 of the corresponding socket contact 8. Consequently, each socket contact 8 is fixed relative to the insulator 9 so as not to be movable even in a z-direction perpendicular to the x- and y-directions.

Referring to FIGS. 6A to 6C, 7A and 7B, description will be given about processes from insertion of the socket contacts 8 into the grooves 16 of the insulator 9 up to fixation thereof.

Figure 6A:
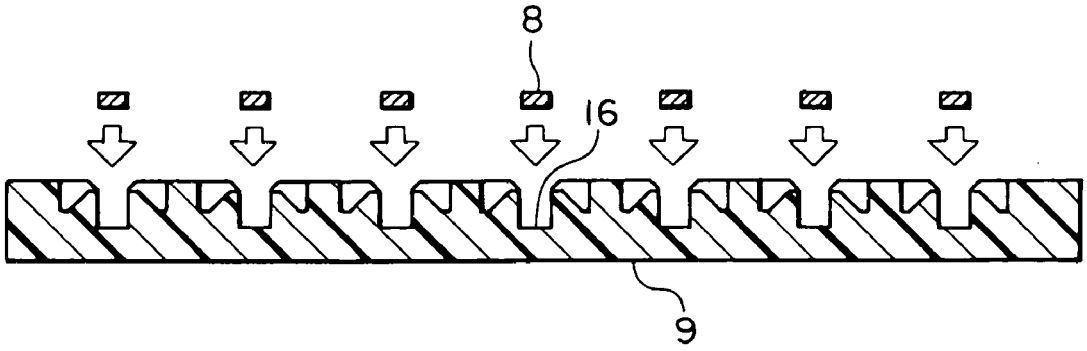
FIGS. 6A to 6C are sectional views for explaining processes of making the contact set retained by the insulator.
Figure 6B:
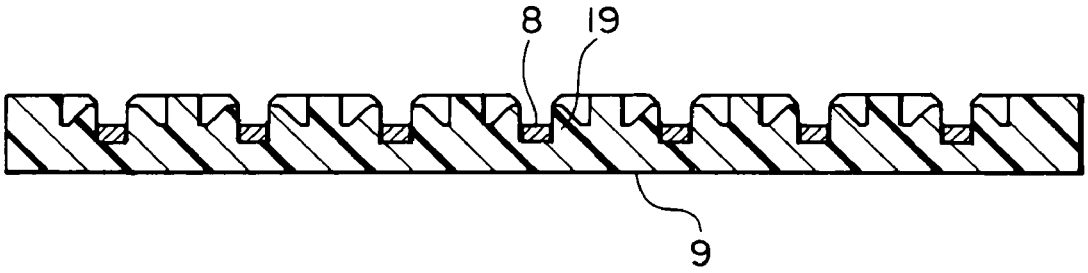
Figure 6C:
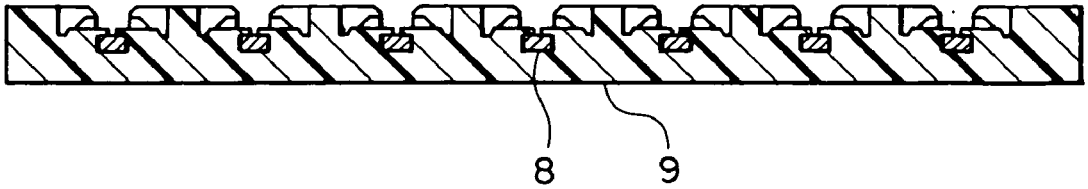
Figure 7A:
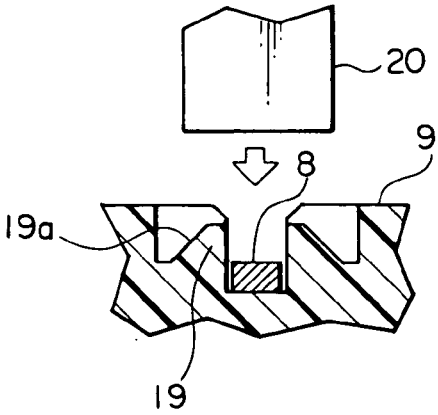
FIGS. 7A and 7B are sectional views for explaining a caulking method of fixing the contact set to the insulator.
Figure 7B:
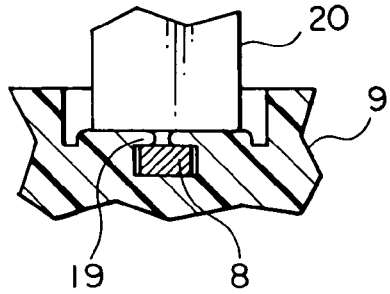

First, as shown in FIG. 6A, when the socket contacts 8 are moved in a direction of arrows to be received in the grooves 16 of the insulator 9, the state is reached as shown in FIGS. 6B and 7A. Then, when each caulking portion 9 is deformed by caulking using a jig 20, the state as shown in FIGS. 6C and 7B is reached so that the socket contacts 8 are fixed to the insulator 9. Although each caulking portion 19 has tapers 19*a*, confronting surfaces of the caulking portion 19 and the jig 20 are parallel to each other. If the jig 20 has a heating function, it is possible to reduce a load applied to the insulator 9 upon caulking.

Description will be given about other techniques for deforming each caulking portion 19.

Figure 8A:
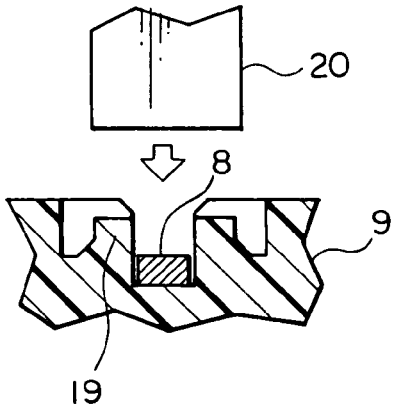
FIGS. 8A and 8B are sectional views for explaining another caulking method.
Figure 8B:
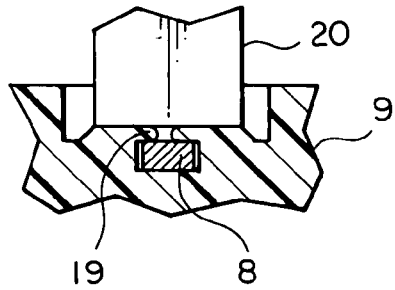

It may be configured such that confronting surfaces of each caulking portion 19 and a jig 20 are formed parallel to each other as shown in FIG. 8A, and the caulking portion 19 is deformed by the jig 20 as shown in FIG. 8B. Naturally, if the jig 20 has a heating function, it is possible to reduce a load applied to the insulator 9 upon caulking.

Figure 9A:
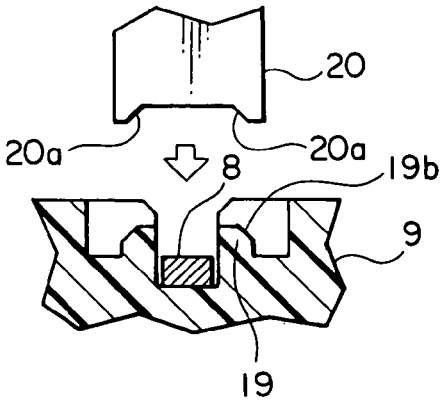
FIGS. 9A and 9B are sectional views of explaining still another caulking method.
Figure 9B:
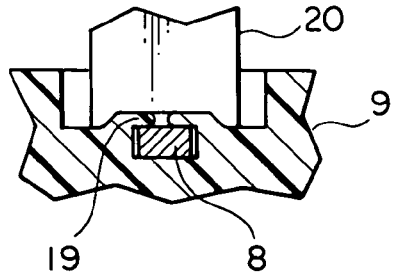
Figures 10A, 10B, 10C, 10D, 10E, 10F:
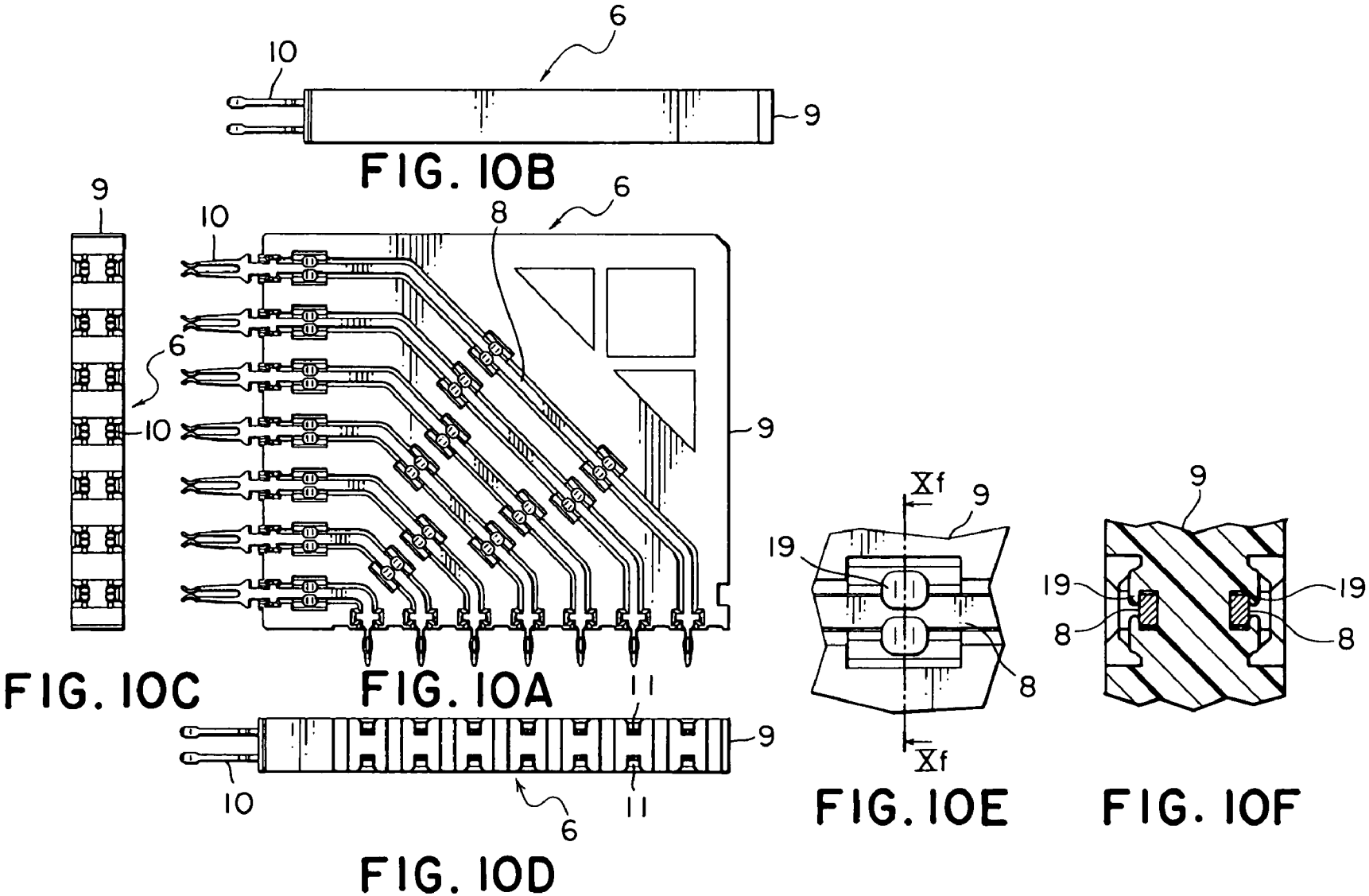
FIG. 10A is a front view of a contact module included in a connector according to another preferred embodiment of the present invention.
FIG. 10B is a plan view of the contact module.
FIG. 10C is a side view of the contact module.
FIG. 10D is a bottom view of the contact module.
FIG. 10E is an enlarged view of the main part of FIG. 10A.
FIG. 10F is a sectional view taken along line Xf—Xf in FIG. 10E.

It may also be configured such that each caulking portion 19 has tapers 19*b* while a confronting surface of a jig 20 also has tapers 20*a* as shown in FIG. 9A, and therefore, caulking is effectively carried out as shown in FIG. 9B. In this event, if the jig 20 has a heating function, it is possible to further reduce a load applied to the insulator 9 upon caulking.

As shown in FIGS. 10A to 10F, socket contacts 8 may be retained or held on both the front and back sides of an insulator 9. In this case, it is possible to use the socket contacts 8 of the same shapes on the front and back sides.

While this invention has thus far been described in conjunction with the preferred embodiments thereof, it will be readily possible for those skilled in the art to put this invention into practice in various other manners without departing from the scope set forth in the appended claims.

What is claimed is:

1. A contact module comprising a conductive contact and an insulator retaining said conductive contact, said conductive contact comprising:

a contact portion at one end thereof;

a terminal portion at the other end thereof; and an intermediate portion connecting said conductive contact portion and said terminal portion to each other and having a positioning-subject portion, said insulator comprising:

a groove formed within said insulator, receiving therein said intermediate portion of said conductive contact;

a positioning portion provisionally retains said positioning-subject portion of said conductive contact; and a retaining portion retaining said intermediate portion of said conductive contact, said positioning portion comprising a first recessed portion formed in the vicinity of one end of said groove and a second recessed portion formed in the vicinity of the other end of said groove, said positioning-subject portion comprising a first shoulder portion pressed-fitted into said first recessed portion and a second shoulder portion press-fitted into said second recessed portion, said retaining portion comprising a deformable, caulking portion fixedly retaining said intermediate portion, when deformed, said caulking portion comprising a tapered portion.

2. The contact module according to claim 1, wherein said caulking portion is disposed in the vicinity of said groove and said tapered portion is opposite to said groove.

3. The contact module according to claim 1, wherein said retaining portion comprises a second caulking portions spaced apart from said deformable caulking portion along said groove, said second caulking portion comprising a tapered portion opposite to said groove and deformed to retain said intermediate portion.

4. The contact module according to claim 1, wherein said insulator has a surface of a substantially polygonal shape, and said groove extends along said surface between a first and a second side of said substantially polygonal shape that are adjacent to each other.

5. The contact module according to claim 4, wherein said groove is formed so as to be concave from said surface, said conductive contact is mounted on said insulator so as not to project from said surface, and said positioning portion and said retaining portion are formed so as not to project from said surface.

6. The contact module according to claim 4, wherein said substantially polygonal shape is a substantially rectangular shape.

7. The contact module according to claim 6, wherein said groove comprises a first portion extending perpendicular to said first side and a second portion extending perpendicular to said second side.

8. The contact module according to claim 7, wherein said groove further comprises a third portion connecting between said first portion and said second portion, and said third portion extends obliquely to said first and second sides.

9. A contact module comprising a plurality of conductive contacts and an insulator retaining said conductive contacts, each of said conductive contacts comprising:

a contact portion at one end thereof;

a terminal portion at the other end thereof; and an intermediate portion connecting said conductive contact portion and said terminal portion to each other and having a positioning-subject portion, said insulator comprising:

grooves formed within said insulator, each receiving therein said intermediate portion of the corresponding contact;

positioning portions each positioning said positioning-subject portion of the corresponding contact; and retaining portions each retaining said intermediate portion of the corresponding contact, said positioning portion comprising a first recessed portion formed in the vicinity of one end of said groove and a second recessed portion formed in the vicinity of the other end of said groove, said positioning-subject portion comprising a first shoulder portion pressed-fitted into said first recessed portion and a second shoulder portion press-fitted into said second recessed portion, said retaining portion comprising a deformable, caulking portion fixedly retaining said intermediate portion, when deformed, said caulking portion comprising a tapered portion.

10. A connector comprising a plurality of plate-like contact modules stacked together, each of said conductive contact modules comprising a conductive contact and a plate-like insulator retaining said conductive contact, said conductive contact comprising:

a contact portion at one end thereof;

a terminal portion at the other end thereof; and an intermediate portion connecting said conductive contact portion and said terminal portion to each other and having a positioning-subject portion, said insulator comprising:

a groove formed within said insulator, receiving therein said intermediate portion of said conductive contact;

a positioning portion positioning said positioning-subject portion of said conductive contact; and a retaining portion retaining said intermediate portion of said conductive contact, said positioning portion comprising a first recessed portion formed in the vicinity of one end of said groove and a second recessed portion formed in the vicinity of the other end of said groove, said positioning-subject portion comprising a first shoulder portion pressed-fitted into said first recessed portion and a second shoulder portion press-fitted into said second recessed portion, said retaining portion comprising a deformable, caulking portion fixedly retaining said intermediate portion, when deformed, said caulking portion comprising a tapered portion.

11. The connector according to claim 10, wherein said groove is formed on the front side of said plate-like insulator.

12. The connector according to claim 11, wherein said groove is formed on the back side of said plate-like insulator.

* * * * *